US008488815B2

(12) United States Patent
Chen

(10) Patent No.: US 8,488,815 B2
(45) Date of Patent: Jul. 16, 2013

(54) SPEAKER SET FOR PORTABLE ELECTRONIC DEVICE

(75) Inventor: Hwang-Miaw Chen, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 8 days.

(21) Appl. No.: 13/293,138

(22) Filed: Nov. 10, 2011

(65) Prior Publication Data

US 2012/0308054 A1 Dec. 6, 2012

Related U.S. Application Data

(63) Continuation-in-part of application No. 13/236,659, filed on Sep. 20, 2011, now abandoned.

(30) Foreign Application Priority Data

May 30, 2011 (CN) ..... 2011 1 0142366

(51) Int. Cl.
*H04R 25/00* (2006.01)
*H04R 1/00* (2006.01)

(52) U.S. Cl.
USPC ..... 381/162; 455/569.1; 379/428.01; 379/433.01

(58) Field of Classification Search
USPC ..... 381/332, 334, 338, 345, 349, 386, 381/395; 455/569.1, 575.2; 379/428.01, 431, 379/433.01, 433.02
See application file for complete search history.

(56) References Cited

U.S. PATENT DOCUMENTS

| | | | | |
|---|---|---|---|---|
| 5,956,622 | A * | 9/1999 | Lee | 340/7.6 |
| 7,894,620 | B2 * | 2/2011 | Yang | 381/345 |
| 2003/0165249 | A1 * | 9/2003 | Higuchi | 381/318 |
| 2011/0311090 | A1 * | 12/2011 | Nagumo et al. | 381/398 |

* cited by examiner

*Primary Examiner* — Brian Ensey
*Assistant Examiner* — Norman Yu
(74) *Attorney, Agent, or Firm* — Altis Law Group, Inc.

(57) ABSTRACT

An exemplary speaker set includes a shell and a speaker. The shell includes a bottom cover and a top cover engaging with the bottom cover. The bottom cover and the top cover cooperatively define a resonance chamber therebetween. The bottom cover defines a through hole therein. The top cover defines a mounting hole corresponding to and communicating with the through hole. The speaker includes a vibration part and a magnetic part driving the vibration part. The vibration part is inserted the mounting hole and engages with the top cover. The magnetic part is inserted the through hole and intimately engages with the bottom cover.

17 Claims, 4 Drawing Sheets

SPEAKER SET FOR PORTABLE ELECTRONIC DEVICE

CROSS-REFERENCE TO RELATED APPLICATIONS

The present application is a continuation-in-part (CIP) application of patent application Ser. No. 13/236,659 entitled "SPEAKER SET FOR PORTABLE ELECTRONIC DEVICE" and filed on Sep. 20, 2011, now abandoned on Nov. 23, 2011, whose disclosure is incorporated herein by reference in its entirety.

BACKGROUND

1. Technical Field

The present disclosure relates to speaker sets, and particularly, to a speaker set used in an electronic device such as a portable electronic device.

2. Description of Related Art

With the continuing development in audio and sound technology, speaker sets have been widely used in electronic devices such as mobile phones, computers, televisions and other devices providing audio capabilities.

Generally, a speaker set includes a shell and a speaker housed by the shell. The bulk of a typical shell is large and not suitable for many popular, small-sized electronic devices. In addition, some complicated mounting portions are formed on the shell in order to secure the speaker to the shell. It is time consuming to assemble the speaker set, and requires a lot of manpower and material resources.

What is needed, therefore, is a speaker set which can overcome the described limitations.

DETAILED DESCRIPTION

Figure 1:
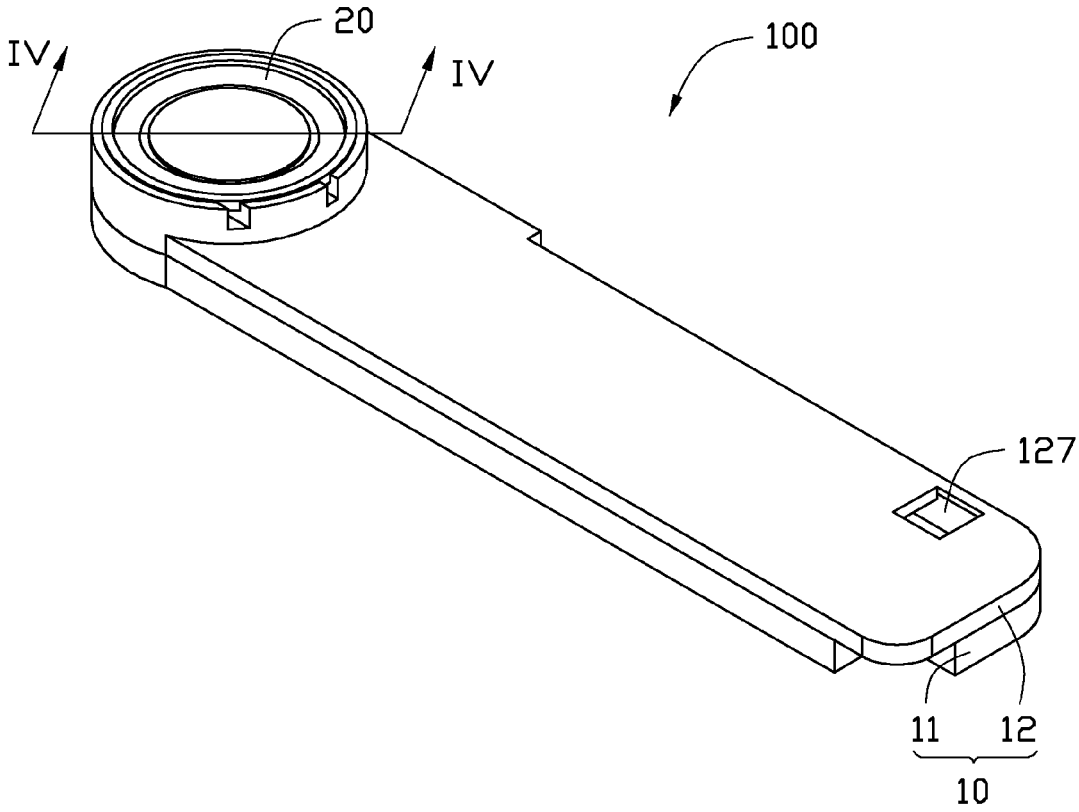
FIG. 1 is an assembled view of a speaker set according to an embodiment of the present disclosure.
Figure 2:
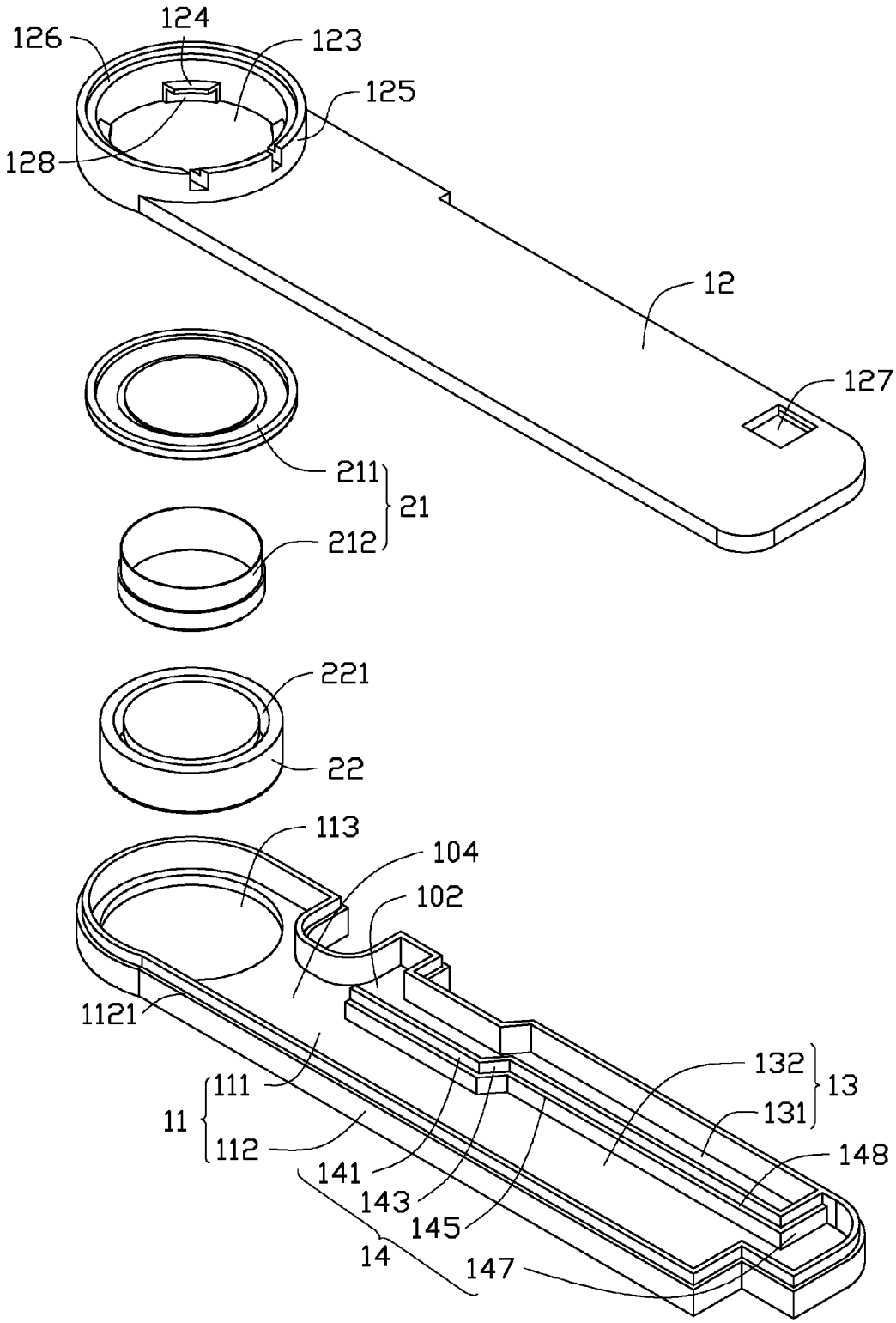
FIG. 2 is an exploded view of the speaker set of FIG. 1.

Referring to FIGS. 1-2, a speaker set 100 is shown. The speaker set 100 includes a shell 10 and a speaker 20 mounted on the shell 10.

In the following description, the stated orientations of all of the elements of the speaker set are with reference to the orientations of all of the elements as shown in FIG. 1.

The shell 10 includes a bottom cover 11, and a top cover 12 joined with the bottom cover 11. Both of the bottom and top covers 11, 12 are semi-enclosed structures. The bottom cover 11 and the top cover 12 cooperatively form a resonance chamber 13 therebetween.

The bottom cover 11 includes an engaging plate 111, and a sidewall 112 extending vertically from an outer periphery of the engaging plate 111 towards the top cover 12. The engaging plate 111 is elongated, and a left end thereof has a substantially semi-circular configuration. A through hole 113 is defined in a central portion of the left end of the engaging plate 111 for receiving the speaker 20. A step 1121 is formed at a top end of the sidewall 112 for conveniently engaging with the top cover 12. An inner side of the step 1121 is higher than an outer side of the step 1121. A front side of the sidewall 112 is straight.

A sound board 14 vertically protrudes from a top surface of the engaging plate 111. Alternatively, the sound board 14 can formed on the top cover 12. The sound board 14 is spaced from and located at a right side of the through hole 113. The sound board 14 includes a first board 141, a second board 143, a third board 145 and a fourth board 147 connected in series. The first board 141 is near the through hole 113. The first and third boards 141, 145 are staggered relative to each other and parallel to each other. The first board 141 is parallel to the front side of the sidewall 112 and near a rear side of the sidewall 112. The second board 143 is positioned between the first and third boards 141, 145 and interconnects the first and third boards 141, 145. The second board 143 is inclined relative to the first board 141 and the third board 145. The fourth board 147 bends from the third board 145 and connects the rear side of the sidewall 112. The fourth board 147 is perpendicular to the third board 145. Each of the first, second, third and fourth boards 141, 143, 145, 147 is rectangular.

A step 148 is formed at a top end of the sound board 14. A side of the step 148 adjacent to the rear side of the sidewall 112 is higher than another side of the step 148 adjacent to the front side of the sidewall 112. Top edges of the steps 148 and 1121 are coplanar. Heights of the steps 148 and 1121 are equal. A first channel 102 and a second channel 104 are defined between a right edge of the through hole 113 and a left end of the first board 141. The first channel 102 communicates with and aligns with the second channel 104. The sound board 14 divides the resonance chamber 13 of the shell 20 into a first chamber 131 and a second chamber 132. The first channel 102 and the second channel 104 correspond to and communicate with the first chamber 131 and the second chamber 132, respectively.

Figure 3:
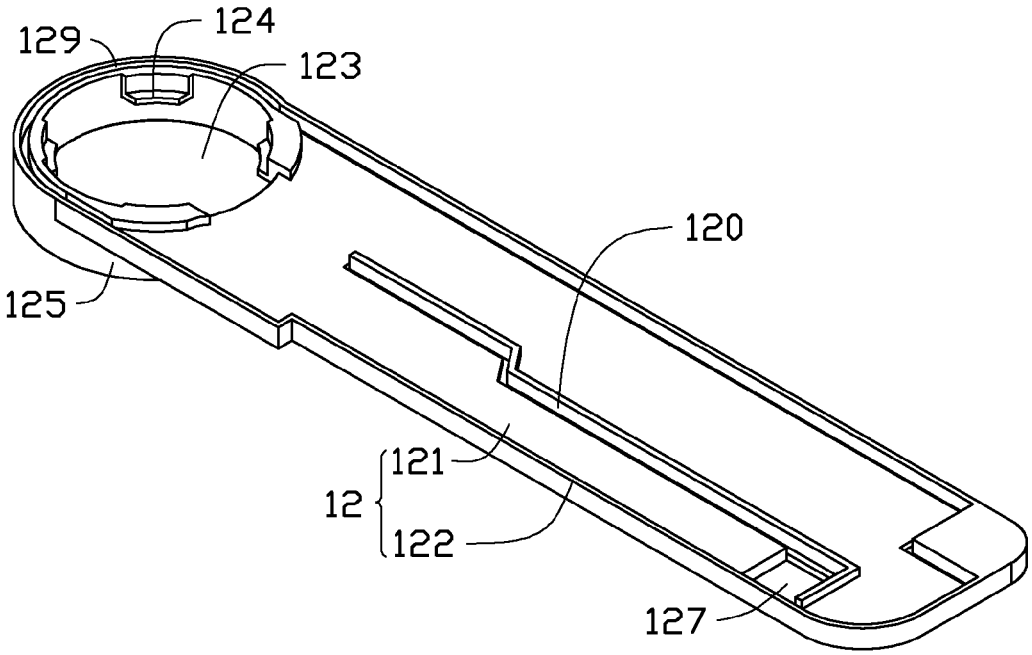
FIG. 3 is a view of a top cover of a shell of the speaker set of FIG. 2 from an inverted aspect.

Referring also to FIG. 3, the top cover 12 includes a mounting plate 121, and a sidewall 122 extending vertically from an outer periphery of the mounting plate 121 towards the bottom cover 11. The mounting plate 121 is elongated, and a left end of the mounting plate 121 has the same shape as the left end of the engaging plate 111. A cylindrical sleeve 125 protrudes upwardly from the left end of the mounting plate 121. A mounting hole 123 is defined in a central portion of the sleeve 125, corresponding to the through hole 113 of the bottom cover 11. Four baffle plates 124 protrude inwardly from an inner surface of the sleeve 125. The baffle plates 124 are located uniformly around an axial of the sleeve 125, and are aligned with each other along a circumferential direction of the sleeve 125. The baffle plates 124 are equally angularly spaced from each other. A distance between an inner surface of an inner end of each baffle plate 124 and the inner surface of the sleeve 125 is constant from a lateral end to an opposite lateral end of each baffle plate 124 along the circumferential direction of the sleeve 125. Each baffle plate 124 is tapered from the inner surface of the sleeve 125 to the inner end of the baffle plate 124 away from the inner surface sleeve 125. That is, a width of the baffle plate 124 decreases from the inner surface of the sleeve 125 to the inner end of the baffle plate 124. Four arc-shaped extending plates 128 protrude from the inner surface of sleeve 125, and extend downwardly from the baffle plates 124, respectively. The extending plates 128 are aligned with each other along the circumferential direction of the sleeve 125, and are equally angularly spaced from each other. Each extending plate 128 is aligned with a corresponding baffle plate 124 and has a constant width equal to a largest width of the baffle plate 124.

A receiving groove 129 is defined in a periphery of a bottom end of the sleeve 125, to receive a left end of the step 1121 of the bottom cover 11 therein. A top end of the sleeve 125 is recessed downwardly to form a cylindrical step 126. A rib 120 protrudes from a bottom surface of the mounting plate 121 to engage with the step 148 of the sound board 14. An opening 127 is defined in a right end of the mounting plate 121 and faces a right end of the first chamber 131, to make the first chamber 131 to communicate with an external environment.

The speaker 20 includes a vibration part 21, and a magnetic part 22 to drive the vibration part 21. The magnetic part 22 extends through the through hole 113 of the bottom cover 11 and interferingly engages with an edge of the engaging plate 111 at the through hole 113, such that the magnetic part 22 is firmly attached on the bottom cover 11. The vibration part 21 is received in the sleeve 125 of the top cover 12.

Figure 4:
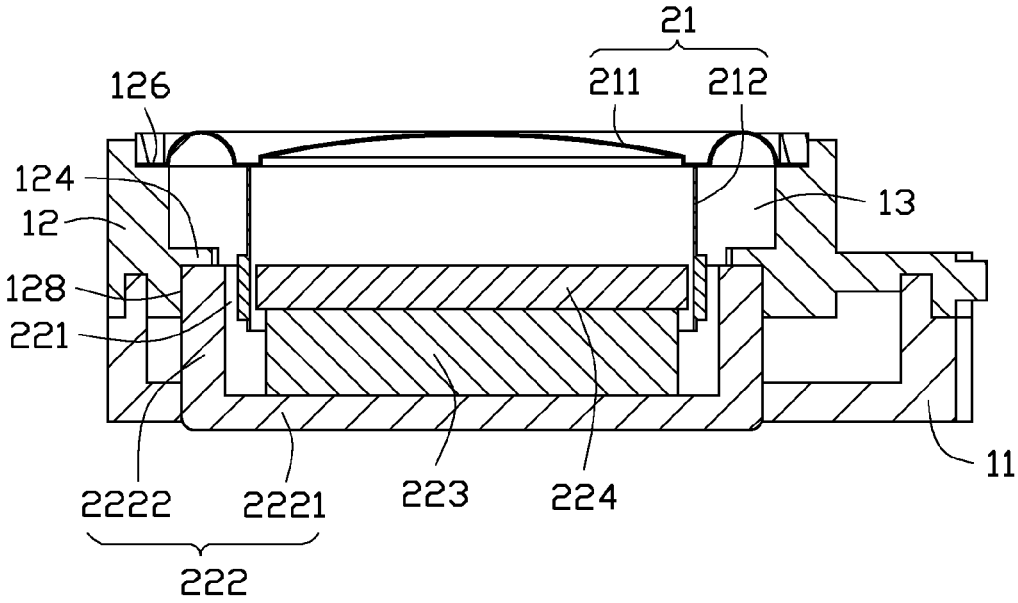
FIG. 4 is a cross sectional view of FIG. 1, take along line IV-IV thereof.

Referring also to FIG. 4, the magnetic part 22 includes a cylindrical yoke 222, a column-shaped magnet 223 enclosed by the yoke 222, and a disk-shaped washer 224 located on the magnet 223. The yoke 222 includes a bottom plate 2221, and a cylindrical sidewall 2222 extending upwardly from a periphery of the bottom plate 2221. A magnetic chamber 221 is defined in the yoke 222. The magnet 223 and the washer 224 are received in the magnetic chamber 221, and stand on the bottom plate 2221 in series. The magnet 223 and the washer 224 are spaced from an inner surface of the sidewall 2222. With such arrangement, the magnetic chamber 221 is reduced to an annular space defined between the inner surface of the sidewall 2222 and outer surfaces of the magnet 223 and the washer 224.

The vibration part 21 includes a generally disk-shaped diaphragm 211 and a hollow cylindrical-shaped coil 212. A periphery of the diaphragm 211 engages with the step 126 of the top cover 12. A top end of the coil 212 is secured on a central portion of a bottom side of the diaphragm 211, and a bottom end of the coil 212 is inserted in the magnetic chamber 221 of the magnetic part 21 when the speaker 20 is assembled.

In assembly of the speaker set 100, firstly, the shell 10 is assembled. The left end of the step 1121 of the sidewall 112 is inserted in the receiving groove 129, and other portions of the step 1121 are inserted in the top cover 12 and abut against inner surfaces of the sidewall 122 of the top cover 12. A bottom end of the sidewall 122 abuts against an outer end of the step 1121. A lateral surface of the step 148 of the sound board 14 of the bottom cover 11 abuts against a lateral surface of the rib 120. A bottom end of the rib 120 abuts against a bottom of the step 148. Thereby, the shell 10 is assembled completely. The sound board 14, the rear side of the sidewall 112 of the bottom cover 11, the engaging plate 111 of the bottom cover 11 and the mounting plate 121 of the top cover 12 cooperatively define the first chamber 131. The sound board 14, the front side of the sidewall 112, the engaging plate 111 and the mounting plate 121 cooperatively define the second chamber 132. The through hole 113 of the engaging plate 111 is aligned with and communicates with the mounting hole 123 of the sleeve 125. The second chamber 132 is larger than first chamber 131.

Then the magnetic part 22 is assembled. The magnetic part 22 is extended through the through hole 113 into the mounting hole 123 until a top end of the sidewall 2222 of the yoke 222 abuts against the baffle plates 124 of the top cover 12. An outer periphery of the top end of the sidewall 2222 interferingly engages with inner surfaces of the extending plates 128 of the sleeve 125 of the top cover 12. An edge of the engaging plate 111 defining the through hole 113 thereof is interferingly attached to a bottom end of an outer periphery of the sidewall 2222 of the yoke 222. A bottom of the yoke 222 slightly protrudes downwardly beyond a bottom of the engaging plate 111. Then the coil 212 is assembled on the diaphragm 211. The coil 212 extends in the mounting hole 123, so that the bottom part of the coil 212 is received in the magnetic chamber 221. A periphery of the diaphragm 211 is attached to the step 126 of the top cover 12 in a manner that a top of the diaphragm 211 slightly protrudes upwardly beyond a top of the sleeve 125. In this state, the second chamber 132 of the resonance chamber 13 communicates with the first chamber 131 through the first channel 102 and the second channel 104, and the first chamber 131 communicates with the outside environment via the opening 127. Therefore, the speaker set 100 is assembled completely.

When the speaker 20 is in use, air of the shell 10 flows from the first and second channels 102, 104 into the first and second chambers 131, 132, respectively. Air of the first chamber 131 flows into the external environment through the opening 127 of the top cover 12. Air of the second chamber 132 circulates in the second chamber 132 to enhance the quality of low frequency range sound of the speaker set 100.

In this embodiment, the sidewall 2222 of the speaker 20 extends through and interferingly engages with the shell 10, so that a thickness of the shell 10 is reduced compared with a conventional shell. Thus, the speaker set 100 is suitable for small sized electronic devices. In addition, all of the elements of the speaker set 100 are simple, so that a process of assembling the speaker set 100 is convenient.

It is to be understood, however, that even though numerous characteristics and advantages of the embodiment(s) have been set forth in the foregoing description, together with details of the structures and functions of the embodiment(s), the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A speaker set comprising:

a shell comprising a bottom cover and a top cover engaging with the bottom cover, the bottom cover and the top cover cooperatively defining a resonance chamber therebetween, the bottom cover defining a through hole therein, and the top cover defining a mounting hole therein corresponding to and communicating with the through hole; and a speaker comprising a vibration part and a magnetic part for driving the vibration part, the vibration part being received in the mounting hole and engaged with the top cover, and the magnetic part being received in the through hole and interferingly engaged with the bottom cover;

wherein the magnetic part defines a magnetic chamber therein, the vibration part comprises a diaphragm and a coil, the diaphragm is attached to the top cover, and the coil is attached to the diaphragm and inserted in the magnetic chamber;

wherein the magnetic part comprises a cylindrical yoke, a magnet and a washer, the yoke comprises a bottom plate and a sidewall extending upwardly from a periphery of the bottom plate, and the magnet and the washer stand on the bottom plate of the yoke in series and are spaced from the sidewall; and wherein the yoke is received in the through hole, a bottom portion of the sidewall of the yoke is interferingly engaged with the bottom cover, and a top portion of the sidewall of the yoke is interferingly engaged with the top cover.

2. The speaker set of claim 1, wherein an extending plate protrudes from an inner surface of the top cover defining the mounting hole, and the extending plate interferingly engages with an outer circumferential face of the top portion of the sidewall of the yoke.

3. The speaker set of claim 1, wherein a baffle plate is formed from an inner circumferential face of the top cover defining the mounting hole, and a top face of the sidewall of the yoke abuts against the baffle plate.

4. The speaker set of claim 3, wherein the baffle plate is connected to a top end of the extending plate.

5. The speaker set of claim 1, wherein a sleeve protrudes from the top cover, the mounting hole is defined in the sleeve, a step is formed on a top end of the sleeve, and a periphery of the diaphragm is attached on the step.

6. The speaker set of claim 1, wherein a bottom of the magnetic part protrudes downwardly beyond a bottom of the bottom cover, and a top of the vibration part protrudes upwardly beyond a top of the top cover.

7. The speaker set of claim 1, wherein a step is formed on the bottom cover, a receiving groove is defined in the top cover, and the step is received in the receiving groove to assemble the top cover and the bottom cover together.

8. The speaker set of claim 1, wherein a sound board is sandwiched between the top and bottom covers and extends along a longitudinal direction of the shell, and the sound board divides the resonance chamber into a first chamber and a second chamber.

9. The speaker set of claim 8, wherein a first channel and a second channel are defined between the speaker and the sound board, and the first and second channels correspond to and communicate with the first and second chambers, respectively.

10. The speaker set of claim 9, wherein an opening is defined in the top cover, and the first chamber communicates with an external environment of the speaker set through the opening.

11. The speaker set of claim 9, wherein the first channel and the second channel communicate with each other.

12. A speaker set comprising:

a shell comprising a bottom cover and a top cover, a step formed on the bottom cover, a sidewall formed on the top cover, and the sidewall of the top cover intimately abutting against the step to define a resonance chamber between the top cover and the bottom cover; and a speaker extending through and interferingly engaged with the shell, the speaker being spaced from the resonance chamber of the shell;

wherein the speaker comprises a vibration part and a magnetic part for driving the vibration part;

wherein the magnetic part comprises a cylindrical yoke, a magnet and a washer, the yoke comprises a bottom plate and a sidewall extending upwardly from a periphery of the bottom plate; and wherein a bottom portion of the sidewall of the yoke is interferingly engaged with the bottom cover, and a top portion of the sidewall of the yoke is interferingly engaged with the top cover.

13. The speaker set of claim 12, wherein a sound board is sandwiched between the top and bottom covers and extends along a longitudinal direction of the shell, and the sound board divides the resonance chamber into a first chamber and a second chamber.

14. The speaker set of claim 13, wherein the bottom cover comprises an engaging plate and a sidewall extending from the engaging plate, the top cover comprises a mounting plate and a sidewall extending from the mounting plate, the step is formed on the sidewall of the bottom cover, and the sound board is sandwiched between the engaging plate and the mounting plate.

15. The speaker set of claim 14, wherein a left end of the sound board is spaced from the speaker, a right end of the sound board connects a rear side of the sidewall of the bottom cover, the first chamber is defined by the sound board, the rear side of the sidewall of the bottom cover, the mounting plate and the engaging plate, and the second chamber is defined by the sound board, a front side of the sidewall of the bottom cover, engaging plate and the mounting plate.

16. The speaker set of claim 15, wherein an opening is defined in the mounting plate of the top cover and communicates with the first chamber of the resonance chamber.

17. The speaker set of claim 15, wherein a first channel and a second channel are defined between the speaker and the first chamber and the second chamber, and the first channel and the second channel communicate with the first chamber and the second chamber, respectively.

* * * * *